United States Patent [19]

Kato

[11] Patent Number: 5,051,335

[45] Date of Patent: Sep. 24, 1991

[54] HEAT DEVELOPABLE LIGHT-SENSITIVE MATERIAL WITH PAPER SUPPORT

[75] Inventor: Masatoshi Kato, Kanagawa, Japan

[73] Assignee: Fuji Photo Film Co., Ltd., Kanagawa, Japan

[21] Appl. No.: 301,555

[22] Filed: Jan. 26, 1989

[30] Foreign Application Priority Data

Jan. 26, 1988 [JP] Japan ..... 63-14892

[51] Int. Cl.[5] ..... G03C 5/54; G03C 1/87; G03C 5/26; G03C 7/30

[52] U.S. Cl. ..... 430/203; 430/214; 430/351; 430/353; 430/509; 430/538; 430/607; 430/608; 430/617; 430/619; 430/539

[58] Field of Search ..... 430/203, 538, 523, 509, 430/617, 607, 608, 539, 619, 351, 353, 214

[56] References Cited

U.S. PATENT DOCUMENTS

| | | | |
|---|---|---|---|
| 3,140,179 | 7/1964 | Russell | 430/509 |
| 4,267,267 | 5/1981 | Ikenoue et al. | 430/538 |
| 4,352,861 | 10/1982 | von Meer et al. | 430/538 |
| 4,729,945 | 3/1988 | Anthonsen et al. | 430/538 |
| 4,755,454 | 7/1988 | Aotsuka et al. | 430/538 |
| 4,770,989 | 9/1988 | Komamura et al. | 430/203 |
| 4,772,542 | 9/1988 | Haga | 430/509 |
| 4,845,018 | 7/1989 | Sato et al. | 430/203 |
| 4,921,781 | 5/1990 | Takamuki et al. | 430/538 |

*Primary Examiner*—Richard L. Schilling
*Attorney, Agent, or Firm*—Sughrue, Mion, Zinn, Macpeak & Seas

[57] ABSTRACT

A novel heat developable light-sensitive material is disclosed, comprising light-sensitive silver halide emulsion layers on a paper support, wherein at least one subbing layer capable of inhibiting fog is provided interposed between the undermost layer among said light-sensitive silver halide emulsion layers and said paper support. In a preferred embodiment, the subbing layer comprises a binder and at least one material capable of inhibiting fog.

12 Claims, No Drawings

HEAT DEVELOPABLE LIGHT-SENSITIVE MATERIAL WITH PAPER SUPPORT

FIELD OF THE INVENTION

The present invention relates to a heat developable light-sensitive material. More particularly, the present invention relates to a heat developable light-sensitive material which is insusceptible to fog and which exhibits excellent raw preservability.

BACKGROUND OF THE INVENTION

A heat developable light sensitive material comprising a silver halide as the light-sensitive component is known in the art. Examples of such heat developable light-sensitive materials are described in *Shaskin Kogaku no Kiso (Elementary Photographic Engineering),* (Non-silver photography), Corona, 1982, pp. 242–255, *Eizo Joho,* April 1978, page 40, Neblets, *Handbook of Photography and Reprography,* 7th ed., Van Nostrand Reinhold Company, pp. 32–33, U.S. Pat. Nos. 3,152,904, 3,301,678, 3,392,020, and 3,457,075, British Patents 1,131,108 and 1,167,777, and *Research Disclosure,* June 1978, pp. 9–15.

Many approaches have been suggested to obtain color images in a heat development process.

For example, a process which comprises the coupling of a coupler and an oxidation product of a developing agent produced by reduction of silver halides to form color images is described in U.S. Pat. Nos. 3,531,286, 3,761,270, and 4,021,240, Belgian Patent 802,510, and *Research Disclosure,* No. 13742.

A process which comprises a silver dye bleach process using silver halides to form positive color images in a heat development process is described in U.S. Pat. No. 4,235,957 and *Research Disclosure,* Nos. 14433 and 15227.

A further process has been suggested which comprises allowing a diffusible dye to form or be released imagewise from a dye-providing compound upon heat development of silver halides and the transferring the diffusible dye to a dye fixing element containing a mordant with a solvent such as water, a high boiling organic solvent, or a hydrophilic thermal solvent incorporated in the dye fixing element. In another embodiment of this process, the mobile dye is heat-diffusible or sublimable. Such a heat-diffusible or sublimable dye is transferred to a dye receiving element on the support. In this process, both negative and positive dye images can be obtained with respect to the same original by altering the kind of dye providing compound or silver halide emulsion used as described in U.S. Pat. Nos. 4,463,079, 4,474,867, 4,478,927, 4,507,380, 4,500,626, and 4,483,914, JP-A-58-149046 (the term "JP-A" as used herein means an "unexamined published Japanese patent application"), JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-62-65038, JP-A-61-23245, and European Patents 210,660A2 and 220,746A2.

The use of paper as a support in such a heat developable light-sensitive material is somewhat advantageous. For example, a paper support is cheaper than a polymer film support such as polyethylene terephthalate film. Furthermore, a light-sensitive material comprising such a paper support can be easily discarded after use. However, such a light-sensitive material comprising a paper support is disadvantageous in that it is highly subject to fog during processing or it is highly subject to fog during storage. Many factors are believed to cause fog in silver halide. For example, it is believed that sodium sulfide, sulfites, or bleaching agents incorporated in pulp, or sizing agents, paper strength improvers, softeners or dimensional stabilizers incorporated during paper making contain a substance which causes fog in silver halide.

Particularly, heat developable light-sensitive materials are more subject to fog and the effects caused by the presence of a slight amount of the above components contained in a paper support, as compared to ordinary photographic light-sensitive materials because they are developed at elevated temperatures.

In general, a paper support for use in a photographic light-sensitive material is often laminated with polyethylene or the like to prevent water from penetrating into the support during processing so that the light-sensitive material can be rapidly dried after processing. However, this approach is disadvantageous in that the above described fogging substances diffuse into the emulsion layer through minute defects (holes) in the polyethylene film and cause fogging in the light-sensitive material during prolonged storage.

SUMMARY OF THE INVENTION

It is therefore an object of the present invention to provide a heat developable light-sensitive material which is essentially insusceptible to fog and which exhibits excellent raw preservability.

The above and other objects of the present invention will become more apparent from the following detailed description and examples.

These objects of the present invention are accomplished with a heat developable light-sensitive material comprising light-sensitive silver halide emulsion layers on a paper support, wherein at least one subbing layer capable of inhibiting fog is provided interposed between the undermost layer among said light-sensitive silver halide emulsion layers and said paper support.

DETAILED DESCRIPTION OF THE INVENTION

The subbing layer capable of inhibiting fog comprises a binder and at least one material capable of inhibiting fog.

The material capable of inhibiting fog is a material which serves to trap (e.g., adsorb or inactivate upon reaction) a fogging substance released from the paper support. Examples of such materials include light-insensitive silver halides, colloidal silver, organic silver salts, activated carbon powder, and porous silicon dioxide powder.

Examples of light-insensitive silver halides which may be used in the present invention include silver chloride, silver bromide, silver iodobromide, silver chlorobromide, silver chloroiodide, and silver chloroiodobromide. The light-insensitive silver halide emulsion may be a monodisperse or polydisperse emulsion or a mixture thereof. The particle size of the emulsion grains is preferably in the range of from 0.01 to 2 $\mu$m, particularly from 0.03 to 0.5 $\mu$m.

The crystal habit of the light insensitive silver halide grains may be cubic, octahedral, tetradecahedral, tabular with a high aspect ratio or the like. The light-insensitive silver halide emulsion is normally used in chemically unripened form. However, the light insensitive silver halide emulsion may be chemically sensitized so long as it practically has no sensitivity. The amount of the light insensitive silver halide emulsion coated is normally in the range of from 1 mg to 10 g/m$^2$ (calculated in terms of amount of silver).

The colloidal silver used in the present invention can be prepared by the reduction of various silver ions with a reducing agent. The grain size of the colloidal silver is preferably in the range of from 0.001 to 0.5 μm, particularly from 0.005 to 0.1 μm. The amount of colloidal silver coated is normally in the range of from 1 mg to 5 g/m$^2$ (calculated in terms of amount of silver).

Examples of organic compounds which may be used to form an organic silver salt to be used in the present invention include benzotriazoles, fatty acids, and other compounds as described in U.S. Pat. No. 4,500,626 (52nd column to 53rd column). Other examples of such useful organic compounds include carboxylic acid silver salts containing an alkynyl group such as silver phenylpropiolate as described in JP A-60-113235, and silver acetylide as described in JP-A-61-249044. These organic silver salts may be used singly or in combination.

The amount of such an organic silver salt coated is preferably in the range of from 1 mg to 10 g/m$^2$ (calculated in terms of amount of silver).

The particle size of the activated carbon powder coated is preferably in the range of from 0.1 to 10 μm. The amount of the activated carbon powder coated is normally in the range of from 1 mg to 5 g/m$^2$.

The particle size of the porous silicon dioxide powder used in the present invention is preferably in the range of from 0.1 to 10 μm. The amount of the porous silicon dioxide powder coated is normally in the range of from 1 mg to 5 g/m$^2$.

The above described materials capable of inhibiting fog can be used singly or in combination.

In the present invention, as a fog trapping agent there is preferably used a substance which has no substantial absorption, particularly in the visible region.

The heat developable light-sensitive elements herein are essentially characterized in that light-sensitive silver halide layers and a binder are provided on a support. Furthermore, the heat developable light-sensitive element optionally may comprise an organometallic salt oxidizing agent, a dye providing compound or the like. (As described later, a reducing agent may concurrently serve as a dye providing compound.) These components may be incorporated in the same layer but may be incorporated in separate layers if they are reactive with each other. For example, if a colored dye providing compound is present in an underlayer of a silver halide emulsion, it can inhibit a decrease in sensitivity. The reducing agent may be preferably incorporated in the heat developable light sensitive element. However, the reducing agent may be supplied from other elements. For example, the reducing agent may be diffused into the heat developable light-sensitive element from a dye fixing element as described later.

In order to obtain a wide range of color in a normal chromaticity diagram with the three primary colors (yellow, magenta and cyan), at least three silver halide emulsion layers having sensitivity in different spectral regions may be used in combination. Examples of such a combination of silver halide emulsion layers include a combination of a blue-sensitive layer, a green-sensitive layer and a red-sensitive layer and a combination of a green-sensitive layer, a red-sensitive layer and an infrared-sensitive layer. These light-sensitive layers may be arranged in various orders commonly used for ordinary color light-sensitive materials. These light-sensitive layers may be optionally divided into two or more layers.

The heat developable light-sensitive element may comprise various auxiliary layers such as a protective layer, undercoat layer, interlayer, yellow filter layer, antihalation layer or backing layer.

The light-sensitive silver halide which may be used in the present invention may be any of silver chloride, silver bromide, silver iodobromide, silver chlorobromide, silver chloroiodide and silver chloroiodobromide.

The light-sensitive silver halide emulsion used in the present invention may be a surface latent image type emulsion or an internal latent image type emulsion. The internal latent image type emulsion may be used as a direct reversal emulsion in combination with a nucleating agent or a light fogging agent. Alternatively, the light-sensitive silver halide emulsion may be a core/shell emulsion in which the interior and the surface of the grain are different from each other in phase. The light-sensitive silver halide emulsion may be a monodisperse or polydisperse emulsion or a mixture thereof. The grain size of the emulsion is preferably in the range of from 0.1 to 2 μm, particularly from 0.2 to 1.5 μm. The crystal habit of the silver halide grains may be cubic, octahedral, tetradecahedral or tabular with a high aspect ratio.

In particular, light-sensitive silver halide emulsions as described in U.S. Pat. Nos. 4,500,626 and 4,628,021, *Research Disclosure,* No. 17029 (1978), and JP-A-62-253159 may be used in the present invention.

The light-sensitive silver halide emulsion may be used unripened but is normally used after being chemically sensitized. For emulsions for the light-sensitive materials, known sulfur sensitization processes, reduction sensitization processes and noble metal sensitization processes may be used singly or in combination. These chemical sensitization processes may be optionally effected in the presence of a nitrogen-containing heterocyclic compound as disclosed in JP-A-62-253159.

The amount of the light sensitive silver halide emulsion coated is in the range of from 1 mg to 10 g/m$^2$ (calculated in terms of amount of silver).

The light-sensitive silver halide used in the present invention may be conventionally spectrally sensitized with a methine dye or the like. Examples of such dyes include cyanine dyes, merocyanine dyes, complex cyanine dyes, complex merocyanine dyes, holopolar cyanine dyes, hemicyanine dyes, styryl dyes and hemioxonol dyes.

Specific examples of dyes include sensitizing dyes as described in U.S. Pat. No. 4,617,257, JP A-59-180550, JP-A 60-140335, and *Research Disclosure,* No. 17029 (1978), pp. 12–13.

These sensitizing dyes may be used singly or in combination. In particular, combinations of sensitizing dyes are often used for the purpose of supersensitization.

The light-sensitive silver halide emulsion may comprise a dye which does not exhibit a spectral sensitizing effect by itself or a compound which does not substantially absorb visible light but exhibits a supersensitizing effect (as described in U.S. Pat. No. 3,615,641 and JP-A-63-23145) together with such a sensitizing dye.

Such sensitizing dyes may be incorporated in the emulsion during, before or after chemical sensitization Alternatively, the sensitizing dye may be incorporated in the emulsion before or after the nucleation of light-sensitive silver halide grains as described in U.S. Pat. Nos. 4,183,756 and 4,225,666. The amount of sensitizing dye incorporated is normally in the range of from $10^{-8}$ to $10^{-2}$ mol per mol of light-sensitive silver halide.

In the present invention, organometallic salts may be used as oxidizing agents in combination with the light-sensitive silver halide. Among such organo-metallic salts, organic silver salts are particularly preferably used.

Examples of organic compounds which can be used to form such an organic silver salt oxidizing agent include benzotriazoles, fatty acids, and other compounds as described in U.S. Pat. No. 4,500,626 (52nd column to 53rd column). Other useful examples of such organic compounds include carboxylic acid silver salts containing an alkynyl group such as silver phenylpropiolate as described in JP-A-60-113235, and silver acetylide as described in JP-A-61-249044. These organic silver salts may be used in combination.

These organic silver salts are generally used in an amount of from 0.01 to 10 mols, preferably from 0.01 to 1 mol, per mol of light-sensitive silver halide. The total amount of light-sensitive silver salt and organic silver salt coated is preferably in the range of from 50 mg to 10 $g/m^2$ (calculated in terms of amount of silver).

In the present invention, various fog inhibitors or photographic stabilizers may be used. Examples of such fog inhibitors or photographic stabilizers include azoles or azaindenes as described in *Research Disclosure*, No. 17643 (1978), pp. 24–25, nitrogen-containing carboxylic acids or phosphoric acids as described in JP-A-59-168442, mercapto compounds and metal salts thereof as described in JP-A-59-111636, and acetylenic compounds as described in JP-A-62-87957.

As suitable reducing agents for the present invention there may be used conventional reducing agents known in the field of heat developable light-sensitive materials. Alternatively, reducing dye-providing compounds as described later may be used. These reducing dye-providing compounds may be used in combination with other reducing agents. Further, a reducing agent precursor which does not exhibit a reducing effect but undergoes reaction with a nucleophilic reagent or under heating to exhibit a reducing effect may be used in the present invention.

Examples of reducing agents used in the present invention include reducing agents or reducing agent precursors as described in U.S. Pat. Nos. 4,500,626 (49th column to 50th column), 4,483,914 (30th column to 31st column), 4,330,617, and 4,590,152, JP-A-60-140335, JP-A-57-40245, JP-A-56-138736, JP-A-59-178458, JP A-59-53831, JP A-59-182449, JP-A 59-182450, JP-A-60 119555, JP-A-60-128436, JP-A-60-128437, JP-A-60-128438, JP-A 60-128439, JP-60-198540, JP-A-60-181742, JP-A-61-259253, JP-A-62-244044, JP-A-62-131253, JP-A-62-131254, JP-A-62-131255, and JP-A-62-131256, and European Patent 220,746A2 (pp. 78–96).

Combinations of various reducing agents as disclosed in U.S. Pat. No. 3,039,869 may also be used in the present invention.

If a non-diffusible reducing agent is used, an electron transfer agent and/or electron transfer agent precursor may optionally be used in combination therewith in order to accelerate the transfer of electrons between the non-diffusible reducing agent and the developable silver halide.

Such an electron transfer agent or its precursor may be selected from the above described reducing agents or precursors thereof. Such an electron transfer agent or its precursor is preferably greater than the non-diffusible reducing agent (electron donor) in mobility. Particularly useful electron transfer agents are 1-phenyl-3-pyrazolidones or aminophenols.

As non-diffusible reducing agents (electron donors) used in combination with such an electron transfer agent there may be used any of the above described reducing agents which are substantially non-diffusible in the layer of light-sensitive element in which they are located. Preferred examples of such non-diffusible reducing agents include hydroquinones, sulfonamidophenols, sulfonamidonaphthols, compounds described as electron donors in JP-A-53-110827, and non-diffusible reducing dye providing compounds as later described.

In the present invention, the amount of such reducing agent(s) incorporated is preferably in the range of from 0.001 to 20 mols, particularly from 0.01 to 10 mols per mol of total silver.

In the present invention, silver may be used as an image-forming substance. A compound which produces or releases a mobile dye in correspondence or counter correspondence to the reduction of silver ions to silver at elevated temperature, i.e., dye-providing compounds, may be incorporated in the light-sensitive material.

Examples of such dye-providing compounds which may be used in the present invention include compounds which undergo an oxidation coupling reaction with a color developing agent to form a dye (coupler). Such a coupler may be a two-equivalent coupler or four-equivalent coupler. A two-equivalent coupler containing a nondiffusible group as a split-off group which undergoes oxidation coupling reaction to form a diffusible dye is preferably used. Specific examples of suitable developing agents and couplers are described in T. H. James, *The Theory of the Photographic Process*, pp. 291–334 and 354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Examples of different dye providing compounds include compounds which serves to imagewise release or diffuse a diffusible dye. Such a compound can be represented by the following general formula (LI):

$$(\text{Dye-Y})_n\text{-Z} \qquad \text{(LI)}$$

wherein Dye represents a dye group, a dye group which has been temporarily shifted to a short wavelength range or a dye precursor group; Y represents a mere bond or connecting group; Z represents a group which makes a difference in the diffusibility of the compound represented by $(\text{Dye-Y})_n$-Z in corresponding or counter-corresponding to light-sensitive silver salts having a latent image distributed imagewise or releases Dye in corresponding or counter-corresponding to light-sensitive silver salts having a latent image distributed imagewise to make no difference in the diffusibility between Dye thus released and $(\text{Dye-Y})_n$-Z; and n represents an integer of 1 or 2. If n is 2, two (Dye-Y)'s may be the same or different.

Specific examples of the dye providing compound represented by the general formula (LI) include the following compounds i to v. The compounds i to iii form a diffusible dye image (positive dye image) in counter-corresponding to the development of silver halide while the compounds iv and v form a diffusible dye image (negative dye image) in corresponding to the development of silver halide.

i. Dye developing agents comprising a hydroquinone developing agent connected to a dye component as described in U.S. Pat. Nos. 3,134,764, 3,362,819, 3,597,200, 3,544,545, and 3,482,972. These dye developing agents are diffusible in alkaline conditions but become nondiffusible upon reaction with silver halide.

ii. Nondiffusible compounds which release a diffusible dye in alkaline conditions but lose their function upon reaction with silver halide as described in U.S. Pat. No. 4,503,137. Examples of such compounds include compounds which undergo intramolecular nucleophilic displacement reactions to release a diffusible dye as described in U.S. Pat. No. 3,980,479, and compounds which undergo an intramolecular rewinding reaction of the isooxazolone ring to release a diffusible dye as described in U.S. Pat. No. 4,199,354.

iii. Nondiffusible compounds that react with a reducing agent left unoxidized after being developed to release a diffusible dye as described in U.S. Pat. No. 4,559,290, European Patent 220,746A2, and Kokai Giho 87-6,199.

Examples of such compounds include compounds which undergo intramolecular nucleophilic displacement reaction after being reduced to release a diffusible dye as described in U.S. Pat. Nos. 4,139,389 and 4,139,379, and JP-A-59-185333, and JP-A-57-84453, compounds which undergo an intramolecular electron transfer reaction after being reduced to release a diffusible dye as described in U.S. Pat. No. 4,232,107, JP-A-59-101649, JP-A-61-88257, and *Research Disclosure,* No. 24,025 (1984), compounds which undergo cleavage of a single bond after being reduced to release a diffusible dye as described in West German Patent 3,008,588A, JP-A-56-142530, and U.S. Pat. Nos. 4,343,893 and 4,619,884, nitro compounds which receive electrons to release a diffusible dye as described in U.S. Pat. No. 4,450,223, and compounds which receive electrons to release a diffusible dye as described in U.S. Pat. No. 4,609,610.

Preferred examples of such compounds include compounds containing an N—X bond (wherein X represents oxygen atom, sulfur atom or nitrogen atom) and an electrophilic group in one molecule as described in European Patent 220,746A2, Kokai Giho 87-6,199, JP-A-63-201653, and JP-63-201654, compounds containing an $SO_2$-X group (wherein X is as defined above) and an electrophilic group in one molecule as described in U.S. application Ser. No. 07/188,779, compounds containing a PO—X bond (wherein X is as defined above) and an electrophilic group in one molecule as described in JP-A-63-271344, and compounds containing a C—X' bond (wherein X' is as defined above for X or represents—$SO_2$—) and an electrophilic group in one molecule as described in JP-A-63-271341.

Particularly preferred among these compounds are compounds containing an N—X bond and an electrophilic group in one molecule. Specific examples of such compounds include Compounds (1) to (3), (7) to (10), (12), (13), (15), (23) to (26), (31), (32), (35), (36), (40), (41), (44), (53) to (59), (64), and (70) described in European Patent 220,746A2, and Compounds (11) to (23) described in Kokai Giho 87-6,199.

iv. Couplers containing a diffusible dye as the split-off group which reacts with an oxidation product of a reducing agent to release a diffusible dye (DDR coupler). Specific examples of such compounds include those described in British Patent 1,330,524, JP-B-48-39165, and U.S. Pat. Nos. 3,443,940, 4,474,867, and 4,483,914.

v. Compounds which are capable of reducing silver halide or organic silver salts and release a diffusible dye after reducing silver halide or organic silver salts (DDR compound). These compounds are advantageous in that they need no other reducing agents. They eliminate image staining due to the action of oxidation decomposition products of reducing agents. Typical examples of such compounds are described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, JP-A-57-179840, and *Research Disclosure,* No. 17,465. Specific examples of DRR compounds include compounds as described in U.S. Pat. No. 4,500,626, 22nd column to 44th column, and particularly preferred among these compounds are compounds (1) to (3), (10) to (13), (16) to (19), (28) to (30), (33) to (35), (38) to (40), and (42) to (64). Other preferred examples of such compounds include those described in U.S. Pat. No. 4,639,408, 37th column to 39th column.

Examples of dye providing compounds other than the above described couplers and compounds of the general formula [LI] include silver dye compounds comprising an organic silver salt connected to a dye as described in *Research Disclosure* (May 1978, pp. 54–58), azo dyes for use in heat developable silver dye bleaching processes as described in U.S. Pat. No. 4,235,957 and *Research Disclosure* (April 1976, pp. 30–32), and leuco dyes as described in U.S. Pat. Nos. 3,985,565 and 4,022,617.

The incorporation of a hydrophobic additive such as a dye providing compound or non-diffusible reducing agent in a layer of light sensitive element can be accomplished by any known method as described in U.S. Pat. No. 2,322,027. In this case, a high boiling organic solvent as described in JP-A-59-83154, JP-A-59-178451, JP-A 59-178452, JP-A-59-178453, JP-A-59-178454, JP-A-59-178455, and JP-A-59-178457 may optionally be used in combination with a low boiling organic solvent having a boiling point of from 50° to 160° C.

The amount of such a high boiling organic solvent incorporated is generally in the range of from 1 to 10 g, preferably 5 g or less, per gram of dye providing compound used or 1 cc or less, preferably 0.5 cc or less, particularly preferably 0.3 cc or less, per gram of binder.

A dispersion process as described in JP-B-51-39853 (the term "JP-B" as used herein means an "examined Japanese Patent Publication") and JP-A-51-59943 which comprises using a polymerization product may also be used.

If a compound which is substantially insoluble in water is used, it may be incorporated in the binder in the form of dispersion of finely divided particles rather than by the above described processes.

In order to disperse a hydrophobic compound in a hydrophilic colloid, various surface active agents can be used. Examples of such surface active agents which may be used in this dispersion process include those described as surface active agent in JP-A-59-157636 (pp. 37–38).

In the present invention, a compound which serves both to accelerate the development of light-sensitive materials and stabilize images may be used. Specific examples of such compounds preferably used in the present invention are described in U.S. Pat. No. 4,500,626 (51st column to 52nd column).

In a system where the diffusion transfer of a dye(s) is used to form images, a dye fixing element is used in combination with the light-sensitive element. Such a dye fixing element may be either coated on a separate support from the light-sensitive element or coated on the same support as the light-sensitive element. For the relationship of the light-sensitive element with the dye fixing element, the support and a white reflecting layer which can be used, those described in U.S. Pat. No. 4,500,626 (57th column) are useful.

The dye fixing element preferably used in the present invention may comprise at least one layer containing a mordant and a binder. As such mordants there may be used those known in the field of photography. Specific examples of such mordants include those described in U.S. Pat. No. 4,500,626 (58th column to 59th column), JP-A-61-88256 (pp. 32–41), JP-A-62-244043 and JP-A-62-244036. Alternatively, a dye-receiving high molecular weight compound as described in U.S. Pat. No. 4,463,079 may be used.

The dye fixing element may optionally comprise auxiliary layers such as a protective layer, strippable layer or anti-curling layer. Particularly, a protective layer can be advantageously incorporated in the dye fixing element.

As suitable binders incorporated in the light-sensitive element or dye fixing element there may be used a hydrophilic binder. Examples of such hydrophilic binders include those described in JP-A-62-253159 (pp. 26–28). Specific examples of such hydrophilic binder include transparent or semi-transparent hydrophilic binders such as proteins (e.g., gelatin, gelatin derivative), polysaccharides (e.g., cellulose derivatives, starch, gum arabic, dextran, pullulan), and synthetic high molecular compounds (e.g., polyvinyl alcohol, polyvinylpyrrolidone, acrylamide polymers). Alternatively, a high water-absorbing polymer as described in JP-A-62-245260, i.e., a homopolymer of a vinyl monomer containing —COOM or —$SO_3M$ (wherein M represents a hydrogen atom or alkali metal) or a copolymer of such vinyl monomers or such a vinyl monomer with other vinyl monomers (e.g., sodium methacrylate, ammonium methacrylate, SUMIKAGEL® L-5H made by Sumitomo Chemical Co., Ltd.) may be used. These binders may be used singly or in combination.

In a system wherein heat development is effected with a slight amount of water, the above described high water-absorbing polymer may be used to expedite the absorption of water. Such a high water-absorbing polymer may be incorporated in the dye fixing layer or in a protective layer therefor to prevent dye which has been transferred from being re-transferred from the dye fixing element to other elements.

In the present invention, the amount of the binder coated is preferably in the range of 20 g or less, more preferably 10 g or less, particularly 7 g or less per $m^2$.

Examples of film hardeners which may be incoroporated in the light-sensitive element or dye fixing element include those described in U.S. Pat. No. 4,678,739 (41st column), JP-A-59-116655, JP-A-62-245261, and JP-A-61-18942. Specific examples of such film hardeners include aldehyde film hardeners (e.g., formaldehyde), aziridene film hardeners, epoxy film hardeners (e.g.,

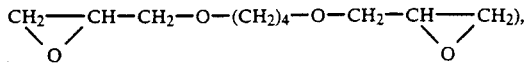

vinylsulfone film hardeners (e.g., N,N'-ethylenebis(-vinylsulfonylacetamido)ethane), N-methylol film hardeners (e.g., dimethylol urea), and high molecular film hardeners (e.g., compounds as described in JP-A-62-234157), In the present invention, the light sensitive element and/or dye fixing element may include an image formation accelerator. Such an image formation accelerator serves to accelerate a redox reaction between a silver salt oxidizing agent and a reducing agent, accelerate production or decomposition of a dye from a dye providing compound or release of a diffusible dye from the dye providing compound, or accelerate transfer of a dye from a light-sensitive material layer to a dye fixing layer. From the physicochemical standpoint, image formation accelerators can be classified into various groups such as base or base precursor, nucleophilic compound, high boiling organic solvent (oil), thermal solvent, surface active agent, and compounds capable of interacting with silver or silver ion. However, these groups normally have composite functions and therefore exhibit a combination of the above described accelerating effects. Details are given in U.S. Pat. No. 4,678,739 (38th column to 40th column).

Examples of such base precursors include salts of an organic acid capable of being heat-decarboxylated with a base, and compounds which undergo an intramolecular nucleophilic displacement reaction, Lossen rearrangement or Beckman rearrangement to release an amine. Specific examples of such base precursors are described in U.S. Pat. No. 4,511,493 and JP-A-62-65038.

In a system where heat development and dye transfer are simultaneously effected in the presence of a small amount of water, such a base and/base precursor may be preferably incorporated in the dye fixing element to improve the storage stability of the light-sensitive element.

Other examples of suitable base precursors include a combination of a sparingly soluble metallic compound and a compound capable of complexing with metal ions constituting said metallic compound as described in European Patent 210,660A, and a compound as described in JP-A 61-232451 which undergoes electrolysis to produce a base. Particularly, the former compound may be effectively used. The sparingly soluble metallic compound and the complexing compound may advantageously be incorporated separately in the light-sensitive element and the dye fixing element.

The present light-sensitive element and/or dye fixing element may comprise various development stopping agents for the purpose of providing images resistant against fluctuations in temperature and time for development.

The term "development stopping agent" as used herein means a compound which readily neutralizes or reacts with a base to reduce the base concentration in the film to stopping development, or which interacts with silver or silver salt to inhibit development, after a proper development period. Specific examples of such compounds include acid precursors which release an acid on heating, electrophilic compounds which undergo a displacement reaction with a base present therewith on heating, and nitrogen-containing heterocyclic compounds, mercapto compounds and precursors thereof.

Details are given in JP-A-62-253159 (pp. 31–32).

The constituent layers (including the backing layer) of the light-sensitive element or dye fixing element may comprise various polymer latexes for the purpose of dimensional stability, inhibiting curling, adhesion, film cracking and pressure sensitization or desensitization or improving other film properties. Specific examples of suitable polymer latexes which may be used include those described in JP-A-62-245258, JP-A-62-136648, and JP-A-62-110066. In particular, if a polymer latex having a low glass transition point (40° C. or lower) is incorporated in the mordant layer, cracking of the mordant layer can be prevented. If a polymer latex having a high glass transition point is incorporated in the backing layer, an anticurling effect can be provided.

The constituent layers of the light-sensitive element or dye fixing element may comprise a high boiling organic solvent as a plasticizer, lubricant or agent for improving the strippability of the light-sensitive element from the dye fixing element. Specific examples of such a high boiling organic solvent include those described in JP-A-62-253159 (page 25) and JP-A-62-245253.

For the above described purposes, various silicone oils ranging from dimethyl silicone oil to modified silicone oil obtained by incorporating various organic groups into dimethylcycloxane may be used. For example, various modified silicone oils, particularly carboxy-modified silicone (trade name: X-22-3710), described at pp. 6–8 of "Modified Silicone Oil", technical data reported by Shin-Etsu Silicone Co., Ltd., may be effectively used.

Silicone oils as described in JP-A-62-215953 and JP-A-63-46449 may also be effectively used.

The light-sensitive element or dye fixing element may comprise a discoloration inhibitor. As such a discoloration inhibitor there may be used an anti-oxidant, ultraviolet absorber or certain kinds of metal complexes.

Examples of such an antioxidant include chroman compounds, coumaran compounds, phenol compounds (e.g., hindered phenols), hydroquinone derivatives, hindered amine derivatives, and spiroindane compounds. Other useful antioxidants include compounds as described in JP-A-61-159644.

Examples of suitable ultraviolet absorbers include benzotriazole compounds as described in U.S. Pat. No. 3,533,794, 4-thiazolidone compounds as described in U.S. Pat. No. 3,352,681, benzophenone compounds as described in JP-A-46-2784, and compounds as described in JP-A-54-48535, JP-A-62-136641, and JP-A-61-8256. Other useful ultraviolet absorbers include ultraviolet-absorbing polymers as described in JP-A-62-260152.

Examples of suitable metal complexes include compounds as described in U.S. Pat. Nos. 4,241,155, 4,245,018, (3rd column to 36th column), and 4,254,195 (3rd column to 8th column), JP-A-62-174741, JP-A-61-88256 (pp. 27–29), and JP-A-63-199248.

Useful examples of other discoloration inhibitors are described in JP-A-62-215272 (pp. 125–137).

A discoloration inhibitor for inhibiting discoloration of a dye to be transferred to the dye fixing element may be previously incorporated in the dye fixing element or supplied into the dye fixing element from other elements such as light-sensitive element.

The above described antioxidants, ultraviolet absorbers and metal complexes may be used in combination.

The light-sensitive element or dye fixing element may comprise a fluorescent brightening agent. In particular, such a fluorescent brightening agent may be incorporated in the dye fixing element or supplied into the dye fixing element from other elements such as light-sensitive element. Examples of such fluorescent brightening agents include compounds as described in K. Veenkataraman, *The Chemistry of Synthetic Dyes*, Vol. V, Chapter 8, and JP-A-61-143752. Specific examples of such compounds include stilbene compounds, coumarin compounds, biphenyl compounds, benzoxazolyl compounds, naphthalimide compounds, pyrazoline compounds, and carbostyryl carboxy compounds.

Such a fluorescent brightening agent may be used in combination with a discoloration inhibitor.

The constituent layers of the light-sensitive element or dye fixing element may comprise various surface active agents for the purpose of aiding of coating, improving strippability and lubricity, inhibiting static electrification or accelerating development. Specific examples of such surface active agents are described in JP-A-62-173463 and JP-A-62-183457.

The constituent layers of the light-sensitive element or dye fixing element may comprise an organo-fluoro compound for the purpose of improving lubricity and strippability or inhibiting static electrification. Typical examples of such an organofluoro compound include fluorine surface active agents as described in JP-B-57-9053 (8th column to 17th column), JP-A-61-20944, and JP-A-62-135826, and hydrophobic fluorine compounds such as oily fluorine compounds (e.g., fluorine oil) or solid fluorine compound resins (e.g., tetrafluoroethylene resin).

The light-sensitive element or dye fixing element may comprise a matt agent. Examples of such a matt agent include compounds as described in JP-A-61-88256 (pp. 29) (e.g., silicon dioxide, polyolefin, polymethacrylate) and compounds as described in JP-A-63-279944 and JP-A-63-274952 (e.g., benzoguanamine resin beads, polycarbonate resin beads, AS resin beads).

Furthermore, the constituent layers of the light-sensitive element or dye fixing element may comprise a thermal solvent, an anti-foaming agent, an anti-bacterial and anti-fungal agent or colloidal silica. Specific examples of these additives are described in JP-A-61-88256 (pp. 26–32).

As a suitable support material used for in the present light-sensitive material there may be used a material capable of withstanding the processing temperature. In general, paper or mixed paper made of synthetic resin pulp such as polyethylene and natural pulp may be used.

As paper used as support there may be used any kind of paper such as photographic base paper, plain paper, wood-free paper or Yankee paper.

A support material which particularly preferably used is a material having improved lubricity. The lubricity of such a support material can be represented by a surface property determined in accordance with JIS BO610. In this measurement, a sectional curve is obtained from which a filtered coaxiness curve is derived at a cut-off value of 0.8 mm. This filtered coaxiness curve is measured for maximum filtered coaxiness at a reference length of 2.5 mm. In a preferred support material, there are 10 or less points, particularly 5 or less points, which have a maximum coaxiness of 4 μm or more among 100 given measurement points. More particularly, there are preferably 10 or less points, particularly 5 or less points, which have a maximum coaxiness of 2 μm or more among 100 given measurement points.

The sectional curve is a curve which appears on the section obtained by cutting the surface of the material to be measured along a plane perpendicular to the average surface thereof. The filtered coaxiness curve is a curve obtained by removing surface rough components having short wavelengths from the above described sectional curve through a low pass filter. The cut-off value is a wavelength corresponding to the frequency at which the gain is 70% when a low pass filter having a damping factor of −12 dB/oct is used to obtain a filtered coaxiness curve. The maximum filtered coaxiness is the maximum wavelength ($W_{CM}$) represented in μm within a predetermined length (reference length) (L) on the filtered coaxiness curve.

The reason why the filtered coaxiness curve with a high cut-off value is used to represent the unevenness of the support surface is that the unevenness in density is little affected by an unevenness shorter than a certain wavelength.

The reason why the reference length is 2.5 mm is that the unevenness in density is little affected by the unevenness of the surface having a long wavelength. This tendency becomes remarkable particularly when the length of the support is 100 μm or less.

The measurement of the lubricity of the surface of the support is conducted in accordance with JIS BO610. In this measurement, a feeler process is used to obtain a sectional curve from which a filtered coaxiness curve is derived through a low pass filter having a cut-off value of 0.8 mm. The maximum filtered coaxiness value is determined with a reference length L. In other words, portions having a length of L are randomly sampled. An average line is then determined from these portions such that the sum of the square of the deviation therefrom to the filtered coaxiness curve is minimized.

The maximum filtered coaxiness $W_{CM}$ is then obtained by determining the sum of the deviation from the average line to the height of a wave having the maximum wave height and a wave having the minimum wave height.

The present invention is characterized in that 100 $W_{CM}$'s determined at 100 random points contain 10 or less $W_{CM}$'s which are 4 μm or more.

As a suitable support having the above described property there may be used coated paper. A coated paper is obtained by coating a coating material made of a mineral pigment such as clay and an adhesive such as casein, starch, latex, polyvinyl alcohol or a combination thereof on one or both surfaces of a base paper such as wood-free paper or middle quality paper. By the coated amount of coating material, coated papers are classified into various groups, i.e., art paper (coated amount: about 20 g/m$^2$), coated paper (coated amount: about 10 g/m$^2$), light coated paper (coated amount: about 5 g/m$^2$), and cast coat paper having no high gloss obtained by pressing a paper which has been coated with a coating material against a polished drier while the coating material is plastic. For details, Kami Pulp Gijutsu Kyokai, *Technical Handbook of Paper and Pulp*, 1982, pages 415 and 535–536 can be referenced.

This kind of a coated paper exhibits a high smoothness even if the thickness of the base paper is small. Particularly, cast coat paper has a rather high surface smoothness. The surface smoothness of a light-sensitive layer coated on such a coated paper is also high. Therefore, a light sensitive material provided on such a support and a dye fixing material provided on such a support can be closely laminated with each other, preventing uneven density.

The thickness of the coated paper itself used in the present invention is preferably in the range of from 20 to 200 g/m$^2$, particularly as relatively small as from 50 to 100 g/m$^2$ (calculated in terms of weight per unit area).

Such a support may be used as it is or in the form of a material laminated with a synthetic high molecular compound such as polyethylene on one or both sides thereof. In the case of such a lamination, any polyethylene may be effectively used regardless of its density.

Alternatively, a support obtained by coating an electron beam-curable resin composition on a paper and curing the resin composition may be used.

Such means can improve the smoothness of the support and thus may be effectively used for paper, mixed paper or coated paper.

In order to render the light-sensitive material antistatic and/or lubricant, a support obtained by coating an electrically conductive metal oxide such as alumina sol or $SnO_2$ on a support material may be used.

The surface condition of the present support may be either glossy or matted. Alternatively, the surface condition of the support on the back side may be either glossy or matted. Preferably, the surface condition of the support on the back side is matted in order to inhibit undesirable adhesion.

A support surface treated by vacuum deposition of metal such as aluminum may be used.

In the present invention, a coated paper obtained by coating a coating material on the both sides of a paper support may be used for the purpose of improving the curl balance of the light-sensitive material. Particularly, double-coated paper, single-coated/single-cast paper or a double-coated paper support may be used.

Alternatively, a paper support laminated with a polymer such as polyethylene on both sides thereof may preferably be used. Furthermore a paper support laminated with polyethylenes having different densities on both sides thereof may be effectively used.

A backing layer may be effectively used in the present invention. Such a backing layer may preferably comprise colloidal silica, a high water-absorbing polymer, polymer latex, surface active agent or nonionic polymer such as polyvinylpyrrolidone or dextran.

Thus, a proper support or backing layer permits one to adjust curling. Particularly, if a heat developable image formation apparatus equipped with a roller for conveying the light-sensitive material is used, the amount of curling perpendicular to the plane in the direction of conveyance of the light-sensitive material is preferably smaller than the diameter of the conveying roller abutting against the light-sensitive material while it is on the rise.

The backing layer can be formed by coating a hydrophilic colloid on the opposite side of the support from the emulsion and then drying the coating. Examples of such a hydrophilic colloid include the above described hydrophilic colloid materials.

One or more such backing layers may be provided. The thickness of such a backing layer is not specifically limited but is preferably in the range of from 0.5 to 15 μm, particularly from 1 to 10 μm.

The amount of a binder incorporated in the backing layer is not specifically limited but is preferably in the range of from 0.5 to 15 g/m$^2$.

As a suitable support for the dye fixing element there may be used a material capable of withstanding the processing temperature. In general, paper or a synthetic high molecular weight compound (film) may be used. Specific examples of such a support material which may be used in the present invention include polyethylene terephthalate, polycarbonates, polyvinyl chloride, polystyrene, polypropylene, polyimides or celluloses (e.g., triacetyl cellulose) or a material obtained by incorporating a pigment such as titanium oxide in such a film, a synthetic paper film formed of polypropylene or the like, a mixed paper made of synthetic resin pulp such as polyethylene and natural pulp, Yankee paper, baryta paper, coated paper (particularly cast coat paper), metals, fabrics, and glass.

Such a support material may be used as it is or in the form of a material laminated with a synthetic high molecular weight compound such as polyethylene on one or both sides thereof.

Alternatively, a support material as described in JP-A-62-253159 (pp. 29–31) may be used in the present invention.

These support materials may be coated with a hydrophilic binder, a semiconducting metal oxide such as alumina sol or tin oxide, carbon black or other antistatic agents.

Examples of process for exposing the light-sensitive element to light for imaging include processes which comprise using a camera to photograph scenery or persons, processes which comprise using a printer or enlarger to expose the light-sensitive material to light through a reversal film or negative film, processes which comprise using an exposing machine such as a copying machine to effect scanning exposure of the light-sensitive material to an original through a slit, processes which comprise exposing the light-sensitive material to light representative of image data emitted by a light emitting diode or various lasers, and processes which comprise exposing the light-sensitive material directly or through an optical system to light representative of image data emitted by an image display apparatus such as a CRT, liquid crystal display, electroluminescence display or plasma display.

As a light source for recording images on the light-sensitive material there may be used natural light, tungsten lamp, a light emitting diode, a laser, a CRT or light sources as described in U.S. Pat. No. 4,500,626 (56th column).

Examples of image data which can be recorded on the present light-sensitive material include picture signals from a video camera, electron still camera or the like, a television signal according to Nippon Television Signal Code (NTSC), a picture signal obtained by dividing an original into many pixels by means of a scanner or the like, and a picture signal produced by means of a CG, CAD or like computer.

The heating temperature at which heat development can be effected is preferably in the range of from about 50° C. to about 250° C., particularly from about 80° C. to about 180° C. The dye diffusion transfer process may be effected simultaneously with or after heat development. In the latter case, the heating temperature at which dye transfer can be effected is preferably in the range of from the heating temperature for heat development to room temperature, particularly from 50° C. to a temperature about 10° C. lower than the heating temperature for heat development.

The transfer of a dye can be effected by heating alone. In order to accelerate the dye transfer, a solvent may be used.

Alternatively, a process as described in JP-A-59-218443 and JP-A-61-238056 which comprises heating the light-sensitive material in the presence of a small amount of a solvent, particularly water, to effect development and dye transfer simultaneously or in sequence may be effectively used. The heating temperature for this process is preferably in the range of from 50° C. to a temperature not higher than the boiling point of the solvent. For example, if the solvent is water, the heating temperature is preferably in the range of from 50° C. to 100° C.

Examples of a solvent which may be used to accelerate development and/or transfer of a diffusible dye to the dye fixing layer include water and a basic aqueous solution containing an inorganic alkali metal salt or organic base as described with reference to the image formation accelerators. Other useful examples of solvents include a low boiling solvent and a mixed solution made of such a low boiling solvent and water or a basic aqueous solution. Such a solvent may further comprise a surface active agent, fog inhibitor, sparingly soluble metal salt, complexing compound or the like.

These solvents may be incorporated in either or both of the light-sensitive element and the dye fixing element. The amount of the solvent incorporated in the light-sensitive element and/or dye fixing element may be small such as not more than the weight of the solvent in a volume corresponding to the maximum swelling volume of the total coated films (particularly, not more than the value obtained by subtracting the weight of the entire coated film(s) from the weight of the solvent in a volume corresponding to the maximum swelling volume of the entire coated film(s)) in the light-sensitive or dye fixing solvent.

As the process for incorporating the solvent in the light-sensitive layer or dye fixing layer, those described in JP-A-61-147244 (page 26) can be referenced. Alternatively, the solvent may be incorporated in either or both of the light-sensitive element and the dye fixing element in a microcapsule form or like form.

In order to accelerate transfer of a dye, a hydrophilic thermal solvent which stays solid at normal temperature but dissolves at an elevated temperature may be incorporated in the light-sensitive element or dye fixing element. Such a hydrophilic thermal solvent may be incorporated in either or both of the light-sensitive element and the dye fixing element. The layer in which the solvent is incorporated may be any one of emulsion layer, interlayer, protective layer and dye fixing layer, preferably the dye fixing layer and/or a layer adjacent thereto.

Examples of such a hydrophilic thermal solvent include ureas, pyridines, amides, sulfonamides, imides, anisoles, oximes and other heterocyclic compounds.

In order to accelerate the transfer of a dye, a high boiling organic solvent may be incorporated in the light-sensitive element and/or dye fixing element.

Examples of heating processes at development and/or the dye transfer step include processes which comprise bringing the light-sensitive material into contact with a heated block or plate, processes which comprise bringing the light-sensitive material into contact with a heating plate, hot presser, heat roller, halogen lamp heater, infrared or far infrared lamp heater or the like, and processes which comprises passing the light-sensitive material through a high temperature atmosphere. Alternatively, the light-sensitive element or dye fixing element may be provided with a resistive heating element layer so that it is heated by passing an electric current through the resistive heating element layer. As such a resistive heating element layer there may be used the one described in JP-A-61-145544.

As the pressure conditions and pressure application processes for the lamination of the light-sensitive element and the dye fixing element, those described in JP-A-61-147244 (p. 27) can be used.

For the photographic processing of the photographic element, any suitable heat developing apparatus may be employed.

Examples of such a heat developing apparatus preferably used in the present invention include those described in JP-A-59-75247, JP-A-59-177547, JP-A-59-81353, JP-A-60-18951, and JP-A-U-62-25944 (the term "JP-A-U" as used herein means an "unexamined published Japanese utility model application").

The present invention will be further described in the following examples, but the present invention should not be construed as being limited thereto.

EXAMPLE 1

The preparation of organic silver salts (1) and (2) will be described hereinafter

Organic Silver Salt (1)

28 g of gelatin and 13.2 g of benzotriazole were dissolved in 300 ml of water. The solution thus obtained was then stirred while being kept at a temperature of 40° C. A solution of 17 g of silver nitrate in 100 ml of water was added to the solution over 2 minutes. A precipitant was then added to the solution. The pH of the solution was adjusted to effect sedimentation so that excess salts were removed. The pH of the solution was adjusted to 7.5. As a result, 400 g of a benzotriazole silver emulsion (organic silver salt (1)) was obtained. The emulsion contained tabular or leaf-like crystals having a length of 0.1 to 0.4 μm and a width of 0.02 to 0.07 μm.

Organic Silver Salt (2)

20 g of gelatin and 5.9 g of 4-acetylaminophenylpropiolic acid were dissolved in 1,000 ml of a 0.1% aqueous solution of sodium hydroxide and 200 ml of ethanol. The solution thus obtained was then stirred while being kept at a temperature of 40° C. A solution of 4.5 g of silver nitrate in 200 ml of water was added to the solution over 5 minutes. The pH of the dispersion was then adjusted to effect sedimentation so that excess salts were removed. The pH of the solution was then adjusted to 6.3. As a result, 300 g of a dispersion of organic silver salt (2) was obtained.

The preparation of a dispersion of zinc hydroxide will be described hereinafter.

12.5 g of zinc hydroxide grains having an average particle size of 0.2 μm, 1 g of carboxymethyl cellulose as a dispersant, and 0.1 g of sodium polyacrylate were added to 100 ml of a 4% aqueous solution of gelatin. The admixture was then subjected to grinding in a mill with glass beads having an average particle diameter of 0.75 mm over 30 minutes. The glass beads were then removed from the material to obtain a dispersion of zinc hydroxide.

The preparation of gelatin dispersions of dye providing compounds will be described hereinafter.

| | Yellow | Magenta | Cyan |
|---|---|---|---|
| Dye providing compound | (1) 13 g | (2) 16.8 g | (3) 15.4 g |
| Electron donor 1 | 3.25 g | 3.15 g | 3 g |
| High boiling solvent 2 | 6.5 g | 8.4 g | 7.7 g |

Yellow, magenta and cyan dyes were prepared in accordance with the table shown above. These dyes were then each dissolved in 40 ml of cyclohexanone at a temperature of about 60° C. to prepare uniform solutions. These solutions were then mixed with 100 g of a 10% aqueous solution of lime-treated gelatin, 0.6 g of sodium dodecylbenzenesulfonate, and 50 ml of water with stirring. The admixture was then subjected to dispersion in a homogenizer at 10,000 rpm over 10 minutes. The dispersion thus prepared was then used as a gelatin dispersion of dye providing compound.

Dye Providing Compound

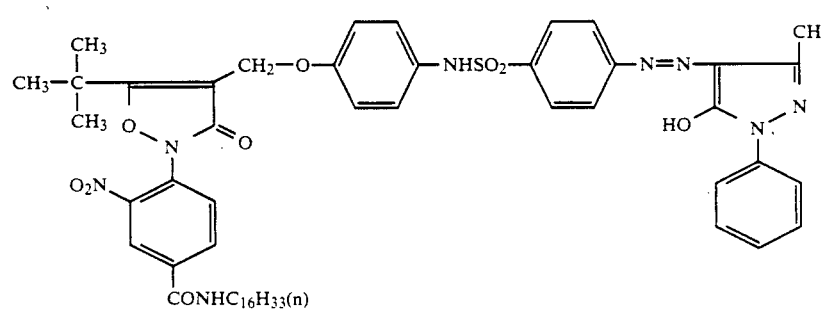

(1)

-continued (2)

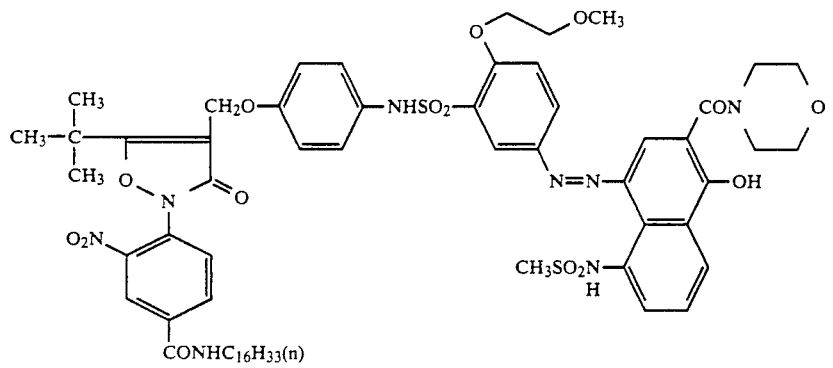

(3)

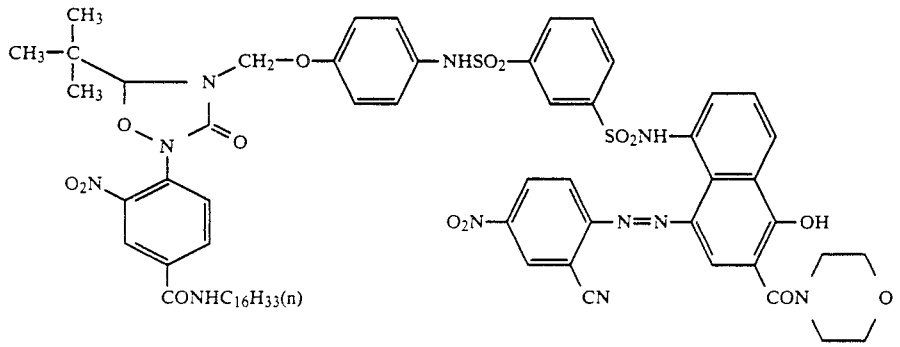

Electron donor 1

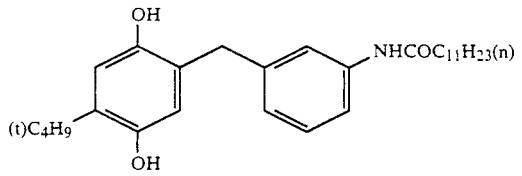

High boiling solvent 2

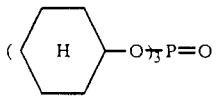

The preparation of a silver halide emulsion will be described hereinafter.

Light-Sensitive Silver Halide Emulsion (I)

Solution (I) and Solution (II) prepared as later described were simultaneously added to an aqueous solution of gelatin (obtained by dissolving 20 g of gelatin, 8 g of sodium chloride, 0.3 g of potassium bromide and 0.015 g of

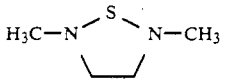

in 600 ml of water and then keeping the solution at 70° C.) with vigorous stirring over 15 minutes and 12 minutes, respectively. Solution (III) prepared as later described was added to the system 15 minutes after the completion of the addition of Solution (I) over 30 minutes. Solution (IV) prepared as later described was then added to the system 13 minutes after the completion of the addition of Solution (II) over 35 minutes. 50 ml of the later mentioned dye solution (A) was added to the system. The reaction system was then allowed to stand for 10 minutes. The reaction system was then washed with water and desalted. 20 g of gelatin was then added to the system to adjust the pH and pAg values thereof to 6.4 and 7.3, respectively. Triethylthiourea was then added to the emulsion at a temperature of 55° C. After 2 minutes, the emulsion was then subjected to optimum chemical sensitization with 4-hydroxy-6-methyl-1,3,3a,7-tetrazaindene. As a result, 600 g of a monodisperse emulsion of cubic silver chlorobromide grains having an average grain size of 0.75 μm (bromide content: 70 mol %) (Emulsion (I)) was obtained.

| | $AgNO_3$ (g) | KBr (g) | NaCl (g) |
|---|---|---|---|
| Solution (I) (water added to make 120 ml) | 20 | — | — |
| Solution (II) (water added to make 90 ml) | — | 7.4 | 1.6 |
| Solution (III) (water added to make 500 ml) | 80 | — | — |
| Solution (IV) (water added | — | 41.7 | 8.8 |

-continued

| | $AgNO_3$ (g) | KBr (g) | NaCl (g) |
|---|---|---|---|
| to make 530 ml) | | | |

Preparation of Dye Solution (A)

Dye (a)

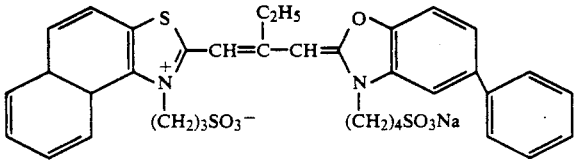

Dye (b)

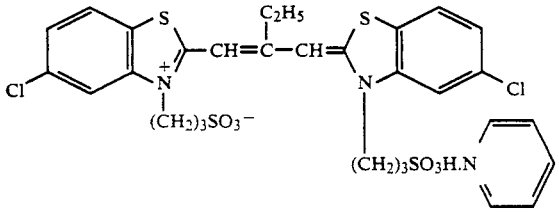

0.3 g of Dye (a) and 0.1 g of Dye (b) were dissolved in 200 ml of methanol with stirring.

Light Sensitive Silver Halide Emulsion (II)

600 ml of an aqueous solution of sodium chloride and potassium bromide, an aqueous solution of silver nitrate obtained by dissolving 0.59 mol of silver nitrate in 600 ml of water, and 120 ml of the later mentioned dye solution (C) were simultaneously added to an aqueous solution of gelatin (obtained by dissolving 20 g of gelatin and 10 g of sodium chloride in 1,000 ml of water and keeping the solution at a temperature of 75° C.) at the same flow rate with vigorous stirring over 60 minutes. As a result, a monodisperse emulsion of dye-adsorbed cubic silver chlorobromide grains having an average grain size of 0.65 μm (bromide content: 80 mol %) was obtained.

After being washed with water and desalted, the emulsion was then subjected to chemical sensitization with 5 mg of sodium thiosulfate and 20 mg of 4-hydroxy-6-methyl-1,3,3a,7-tetrazaindene at a temperature of 60° C. The yield of the emulsion thus obtained was 600 g.

Preparation of Dye Solution (C)

Dye (c)

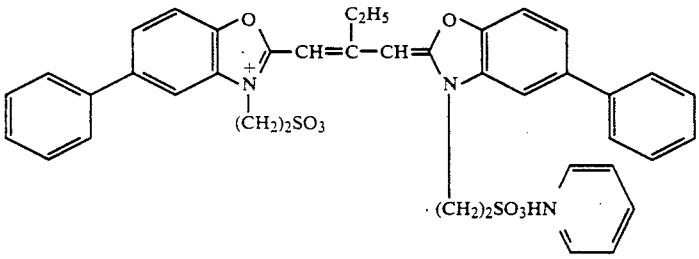

0.3 9 of Dye (c) was dissolved in 200 ml of methanol.

Light-Sensitive Silver Halide Emulsion (III)

Solution (I') and Solution (II') described below were simultaneously added to an aqueous solution of gelatin (obtained by dissolving 20 g of gelatin, 3 g of potassium bromide and 1 g of $HO(CH_2)_2S(CH_2)_2S(CH_2)_2OH$ in 600 ml of water and keeping the solution at a temperature of 75° C.) with vigorous stirring over 20 minutes. Solution (III') and Solution (IV') were then simultaneously added to the reaction system over 30 minutes. The emulsion was then washed with water and desalted. 20 g of lime-treated ossein gelatin was added to the emulsion to adjust the pH and pAg values thereof to 6.2 and 8.5, respectively. The emulsion was then subjected to optimum chemical sensitization with sodium thiosulfate, chloroauric acid and 4-hydroxy-6-methyl-1,3,3a,7 tetrazaindene. As a result, 600 g of a monodisperse emulsion of octahedral silver iodobromide grains having an average grain size of 0.92 μm was obtained.

| | $AgNO_3$ (g) | KBr (g) | NaCl (g) |
|---|---|---|---|
| Solution (I') (water added to make 200 ml) | 30 | — | — |
| Solution (II') (water added to make 200 ml) | — | 19 | 2.9 |
| Solution (III') (water added to make 400 ml) | 70 | — | — |
| Solution (IV') (water added to make 400 ml) | — | 48 | 1.4 |

15 g of Electron donor 2 and 7.5 g of tricresyl phosphate were dissolved in 30 ml of ethyl acetate at a temperature of about 50° C. to prepare a uniform solution. The solution thus obtained was then mixed with 100 g of a 10% aqueous solution of lime-treated gelatin, 0.5 g of sodium dodecylbenzenesulfonate and 50 ml of water with stirring. The admixture was subjected to dispersion in a homogenizer at 10,000 rpm over 10 minutes. The dispersion thus obtained was then used as a gelatin dispersion of a color stain inhibitor for an interlayer.

Electron Donor 2

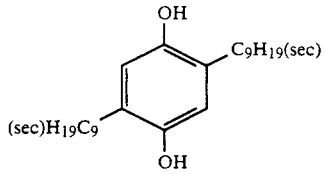

The materials thus obtained were then used to prepare light-sensitive materials 101 to 106 as shown in Table 1.

TABLE 1

(Constitution of Light-Sensitive Material 101)

| Layer No. | Layer name | Additive | Coated amount (mg/m$^2$) |
|---|---|---|---|
| 7th Layer | Protective layer | Gelatin | 850 |
| | | Silica (size: 4 μm) | 40 |
| | | Polymer (Note 1) | 250 |
| | | Film hardener (Note 2) | 60 |
| | | Surface active agent (Note 3) | 150 |
| 6th Layer | Blue-sensitive emulsion layer | Light-sensitive silver halide emulsion (III) | 650 (calculated in terms of silver) |
| | | Yellow dye providing compound (1) | 560 |
| | | Gelatin | 500 |
| | | Electron donor-1 | 140 |
| | | High boiling solvent 2 | 280 |
| | | Electron transfer agent ETA-1 (Note 4) | 40 |
| | | Electron donor 3 (Note 5) | 110 |
| | | Fog inhibitor 2 (Note 6) | 1.5 |
| 5th Layer | Inter-layer | Gelatin | 750 |
| | | Zinc hydroxide | 300 |
| | | Electron donor 2 | 320 |
| | | Tricresyl phosphate | 160 |
| | | Surface active agent (Note 7) | 70 |
| 4th Layer | Green-sensitive emulsion layer | Light-sensitive silver halide emulsion (II) | 420 (calculated in terms of silver) |
| | | Magenta dye providing compound (2) | 380 |
| | | Gelatin | 450 |
| | | Electron donor 1 | 71 |
| | | High boiling solvent 2 | 190 |
| | | Electron transfer agent ETA-1 (Note 4) | 36 |
| | | Electron donor 3 (Note 5) | 100 |
| | | Fog inhibitor 3 (Note 8) | 1 |
| 3rd Layer | Inter-layer | Gelatin | 750 |
| | | Zinc hydroxide | 320 |
| | | Electron donor 2 | 300 |
| | | Tricresyl phosphate | 150 |
| | | Surface active agent (Note 7) | 105 |
| 2nd Layer | Red-sensitive emulsion layer | Light-sensitive silver halide emulsion (I) | 390 (calculated in terms of silver) |
| | | Cyan dye providing compound (3) | 350 |
| | | Gelatin | 500 |
| | | Electron donor 1 | 68 |
| | | High boiling solvent 2 | 175 |
| | | Electron transfer agent ETA-1 (Note 4) | 38 |
| | | Electron donor 3 (Note 5) | 110 |
| | | Fog inhibitor 3 (Note 8) | 1 |
| 1st Layer | Subbing layer | Gelatin | 950 |
| | | Zinc hydroxide | 100 |
| | | Organic silver salt (1) | 50 (calculated in terms of silver) |
| Support | | Polyethylene layer (comprising 8 wt % $TiO_2$ dispersed therein) | 45 μm |
| | | Cast coat layer | 10 μm |
| | | Coated layer | 10 μm |
| | | Plain paper | 60 μm |
| | | Coated layer | 10 μm |

TABLE 1-continued (Constitution of Light-Sensitive Material 101)

| Layer No. | Layer name | Additive | Coated amount (mg/m$^2$) |
|---|---|---|---|
| | | Polyethylene layer | 35 μm |
| Backing Layer | Anti-curling layer | Gelatin | 3,500 |
| | | Film hardener (Note 2) | 70 |
| | | Silica (size: 4 μm) | 100 |

Light-sensitive materials 102 to 106 were prepared in the same manner as for light-sensitive material 101 except that the organic silver salt (1) incorporated in the 1st layer was replaced by a fog inhibiting material as described later in an amount as described later.

| Light-Sensitive Material No. | Fog Inhibitor | Coated Amount (mg/m$^2$) |
|---|---|---|
| 102 | Organic silver salt (2) | 42 (as calculated in terms of silver) |
| | Colloidal silver (size: 0.01 μm) | 30 (30) |
| 104 | Activated carbon powder (size: 0.7 μm) | 200 |
| 105 | Porous silicon dioxide powder (size: 0.5 μm) | 350 |
| 106 | None | |

-continued

| Light-Sensitive Material No. | Fog Inhibitor | Coated Amount (mg/m²) |
|---|---|---|
| (comparative) | | |

(Note 1)
Sodium polyacrylate-polyvinyl alcohol block polymer
(Note 2)
1,2-Bis(vinylsulfonylacetamido)ethane
(Note 3)

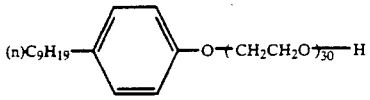

(Note 4)

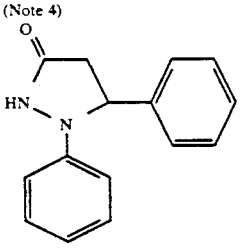

(Note 5)

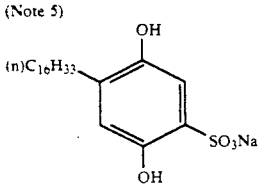

(Note 6)

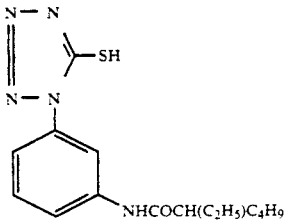

(note 7)

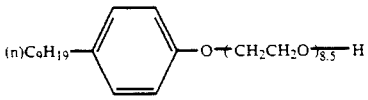

(Note 8)

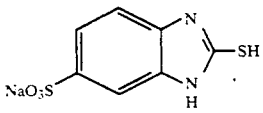

The preparation of a dye fixing material will be described hereinafter.

A dye fixing material R-1 was prepared by coating the following compositions on a polyethylene-laminated paper support.

TABLE 2

(Constitution of Dye Fixing Material R-1)

| Layer No. | Additive | Added Amount (g/m²) |
|---|---|---|
| 3rd Layer | Gelatin | 0.05 |
| | Silicone oil *1 | 0.04 |
| | Surface active agent *2 | 0.001 |
| | Surface active agent *3 | 0.02 |
| | Surface active agent *4 | 0.10 |
| | Guanidine picolinate | 0.45 |
| | Polymer *5 | 0.24 |
| 2nd Layer | Mordant *6 | 2.35 |
| | Polymer *7 | 0.60 |
| | Gelatin | 1.40 |
| | Polymer *5 | 0.21 |
| | High boiling solvent *8 | 1.40 |

TABLE 2-continued (Constitution of Dye Fixing Material R-1)

| | | |
|---|---|---|
| | Guanidine picolinate | 1.80 |
| | Surface active agent *2 | 0.02 |
| 1st Layer | Gelatin | 0.45 |
| | Surface active agent *4 | 0.01 |
| | Polymer *5 | 0.04 |
| | Film hardener *9 | 0.30 |
| Paper support laminated with polyethylene comprising 10 wt % $TiO_2$ dispersed therein (thickness: 170 μm) | | |
| 1st Backing Layer | Gelatin | 3.25 |
| | Film hardener *9 | 0.25 |
| 2nd Backing Layer | Gelatin | 0.44 |
| | Silicone oil *1 | 0.08 |
| | Surface active agent *2 | 0.002 |
| | Mat agent *10 | 0.09 |

Silicone oil *1

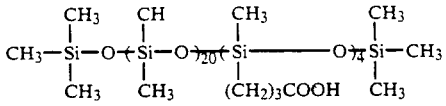

Surface active agent *2: Aerosol ® OT

Surface active Agent *3: $C_8F_{17}SO_2N(C_3H_7)CH_2COOK$

Surface active agent *4: $C_{11}H_{33}CONHCH_2CH_2CH_2N^{\oplus}(CH_3)_2CH_2COO^{\ominus}$ Polymer *5: Vinyl alcohol-sodium acrylate copolymer (molar ratio: 75/25)

*7: Dextran (molecular weight: 70,000)

Mordant *6

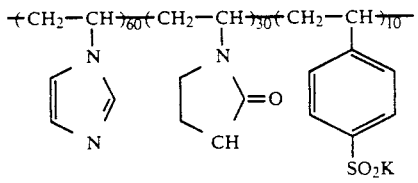

High boiling solvent *8: Reofos ® 95 (Ajinomoto Co., Inc.)

Film hardener *9

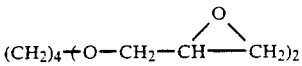

Mat agent *10: Benzoguanamine resin (average particle size: 10 μm)

One group of these light-sensitive materials 101 to 106 was subjected to forced deterioration test at a temperature of 40° C. and a relative humidity of 80% over 5 days. This group was then subjected to the following processing together with the other group which had not been subjected to forced deterioration test.

Specifically, the multilayer color light-sensitive materials 101 to 106 were exposed to light from a tungsten lamp through B, G, R and grey separation filters having a gradient density for 1/10 second.

These exposed materials were fed at a linear rate of 20 mm/sec. while their emulsion surfaces were being supplied with water through a wire bar in an amount of 15 ml/m². These materials were each immediately superposed on the dye fixing material R-1 in such a manner that their film surfaces were brought into contact with each other.

These laminates were then heated for 15 seconds by passage over a heat roller which had been adjusted so that the temperature of the water-absorbed film reached 90° C. When these materials were then stripped off the dye fixing material, sharp even blue, red and grey images were obtained on the dye fixing material in correspondence to the B, G, R and grey separation filters, respectively.

The maximum density ($D_{max}$) and minimum density ($D_{min}$) of cyan, magenta and yellow at grey image areas were measured. The results are shown in Table 3.

TABLE 3

| Light-Sensitive Material No. | | Before forced deterioration test Dmax | Dmin | After storage at 40° C., 80% RH Dmax | Dmin |
|---|---|---|---|---|---|
| 101 | Cyan | 2.06 | 0.15 | 2.04 | 0.19 |
| | Magenta | 2.22 | 0.15 | 2.20 | 0.18 |
| | Yellow | 2.09 | 0.16 | 2.08 | 0.19 |
| 102 | Cyan | 2.10 | 0.14 | 2.08 | 0.18 |
| | Magenta | 2.22 | 0.15 | 2.01 | 0.18 |
| | Yellow | 2.06 | 0.15 | 2.06 | 0.19 |
| 103 | Cyan | 2.12 | 0.15 | 2.08 | 0.17 |
| | Magenta | 2.20 | 0.14 | 2.20 | 0.18 |
| | Yellow | 2.10 | 0.15 | 2.05 | 0.17 |
| 104 | Cyan | 2.08 | 0.16 | 2.05 | 0.18 |
| | Magenta | 2.26 | 0.16 | 2.24 | 0.19 |
| | Yellow | 2.08 | 0.15 | 2.06 | 0.18 |
| 105 | Cyan | 2.07 | 0.14 | 2.06 | 0.20 |
| | Magenta | 2.21 | 0.14 | 2.20 | 0.19 |
| | Yellow | 2.10 | 0.15 | 2.08 | 0.19 |
| 106 | Cyan | 2.02 | 0.16 | 1.76 | 0.20 |
| (comparative) | Magenta | 2.20 | 0.15 | 2.04 | 0.18 |
| | Yellow | 2.05 | 0.16 | 2.03 | 0.19 |

It is demonstrated from the results shown in Table 3 that the comparative material wherein the subbing layer is free of any fog inhibitor is susceptible to fogging in the light-sensitive silver halide grains, which causes a decrease in the Dmax of positive dye images while the present light sensitive materials 101 to 105 exhibit a less decrease in Dmax.

EXAMPLE 2

The preparation of the light-insensitive silver halide emulsion used in this Example will be described hereinafter.

600 ml of an aqueous solution of sodium chloride and an aqueous solution of silver nitrate (obtained by dissolving 0.59 mol of silver nitrate in 600 ml of water) were simultaneously added to an aqueous solution of gelatin (obtained by dissolving 20 g of gelatin and 1 g of sodium chloride in 1,000 ml of water and then keeping the solution at a temperature of 28° C.) at the same flow rate with vigorous stirring over 15 minutes. As a result, an emulsion of light-insensitive silver chloride grains having an average grain size of 0.1 μm was obtained.

The emulsion was washed with water and desalted. The yield of the emulsion was 600 g.

The preparation of a light-sensitive silver halide emulsion (IV) will be described hereinafter.

600 ml of an aqueous solution containing sodium chloride and potassium bromide and an aqueous solution of silver nitrate (obtained by dissolving 0.59 mol of silver nitrate in 600 ml of water) were simultaneously added to an aqueous solution of gelatin (obtained by dissolving 20 g of gelatin and 3 g of sodium chloride in 1,000 ml of water and then keeping the solution at a temperature of 75° C.) at the same flow rate with vigorous stirring over 40 minutes. As a result, a monodisperse emulsion of cubic silver chlorobromide grains having an average grain size of 0.40 μm (bromine content: 50 mol %) was obtained.

After being washed with water and desalted, the emulsion was then subjected to chemical sensitization with 5 mg of sodium thiosulfate and 20 mg of 4-hydroxy-6-methyl 1,3,3a,7-tetrazaindene at a temperature of 60° C. The yield of the emulsion was 600 g.

The preparation of a light-sensitive silver halide emulsion (V) will be described hereinafter.

600 ml of an aqueous solution containing sodium chloride and potassium bromide and an aqueous solution of silver nitrate (obtained by dissolving 0.59 mol of silver nitrate in 600 ml of water) were simultaneously added to an aqueous solution of gelatin (obtained by dissolving 20 g of gelatin and 3 g of sodium chloride in 1,000 ml of water and then keeping the solution at a temperature of 75° C.) at the same flow rate with vigorous stirring over 40 minutes. As a result, a monodisperse emulsion of cubic silver chlorobromide grains having an average grain size of 0.35 μm (bromine content: 80 mol %) was obtained.

After being washed with water and desalted, the emulsion was then subjected to chemical sensitization with 5 mg of sodium thiosulfate and 20 mg of 4-hydroxy-6-methyl-1,3,3a,7-tetrazaindene at a temperature of 60° C. The yield of the emulsion was 600 g.

The preparation of a gelatin dispersion of a dye providing compound will be described hereinafter.

5 g of a yellow dye providing compound (A) and 0.5 g of succinic acid-sodium 2-ethylhexylsulfonate and 10 g of triisononyl phosphate as surface active agents were weighed and dissolved in 30 ml of ethyl acetate at a temperature of about 60° C. to prepare a uniform solution. The solution thus obtained and 100 g of a 3% solution of lime-treated gelatin were mixed with stirring. The admixture was then subjected to dispersion in a homogenizer at 10,000 rpm over 10 minutes. The dispersion was then used as a dispersion of yellow dye providing compound.

A dispersion of magenta dye providing compound was prepared in the same manner as described above except that the yellow dye providing compound (A) was replaced by a magenta dye providing compound (B) and 7.5 g of tricresyl phosphate was further used as a high boiling solvent.

A dispersion of cyan dye providing compound was prepared in the same manner as in the dispersion of yellow dye providing compound except that the yellow dye providing compound (A) was replaced by a cyan dye providing compound (C).

Dye providing compound (A)

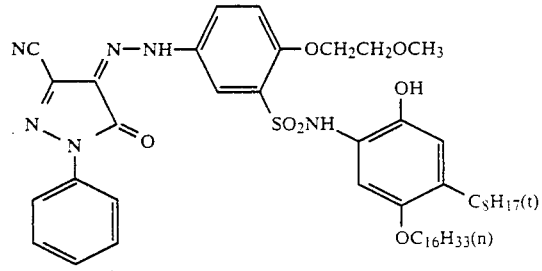

Dye providing compound (B)

-continued

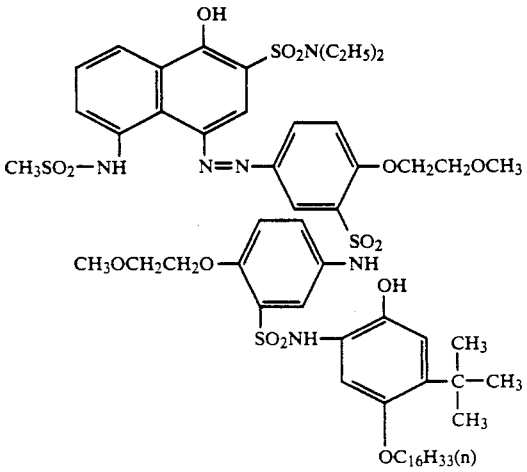

Dye providing compound (C)

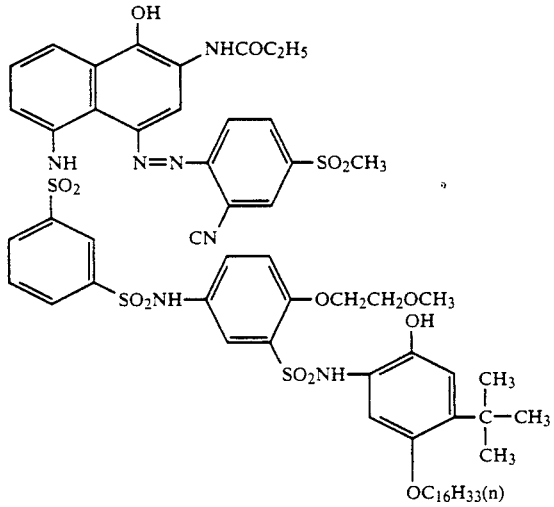

These emulsions and dispersions thus obtained and certain dispersions prepared in Example 1 were then used to prepare a light-sensitive material 201 as shown in Table 4.

TABLE 4

(Constitution of Light-Sensitive Material 201)

| Layer No. | Layer name | Additive | Coated amount (mg/m²) |
|---|---|---|---|
| 7th Layer | Protective layer | Gelatin | 700 |
| | | Silica (size: 4 μm) | 40 |
| | | Polymer (Note 1 in Example 1) | 250 |
| | | Film hardener (Note 2 in Example 1) | 60 |
| | | Surface active agent (Note 3 in Example 1) | 140 |
| 6th Layer | Green-sensitive emulsion layer | Light-sensitive silver halide emulsion (IV) | 400 (calculated in terms of silver) |
| | | Organic silver salt (1) | 30 (30) |
| | | Sensitizing dye (D-1) | $10^{-6}$ mol/m² |
| | | Yellow dye providing compound (A) | 500 |
| | | Gelatin | 700 |
| | | Triisononyl phosphate | 250 |
| 5th Layer | Inter-layer | Gelatin | 800 |
| | | Zinc hydroxide | 300 |

TABLE 4-continued (Constitution of Light-Sensitive Material 201)

| Layer No. | Layer name | Additive | Coated amount (mg/m²) |
|---|---|---|---|
| | | Surface active agent (Note 7 in Example 1) | 100 |
| 4th Layer | Red-sensitive emulsion layer | Light-sensitive silver halide emulsion (V) | 300 (calculated in terms of silver) |
| | | Organic silver salt (2) | 40 (40) |
| | | Sensitizing dye (D-2) | $8 \times 10^{-7}$ mol/m² |
| | | Magenta dye providing compound (B) | 320 |
| | | Gelatin | 400 |
| | | Tricresyl phosphate | 160 |
| 3rd Layer | Inter-layer | Gelatin | 750 |
| | | Zinc hydroxide | 320 |
| | | Surface active agent (Note 7 in Example 1) | 100 |
| 2nd Layer | Infrared-sensitive emulsion layer | Light-sensitive silver halide emulsion (IV) | 300 (calculated in terms of silver |
| | | Sensitizing dye (D-3) | $10^{-8}$ mol/m² |
| | | Cyan dye providing compound (C) | 320 |
| | | Gelatin | 500 |
| | | Triisononyl phosphate | 160 |
| 1st Layer | Subbing layer | Gelatin | 950 |
| | | Zinc hydroxide | 120 |
| | | Light-insensitive silver halide emulsion | 300 (calculated in terms of silver) |
| Support | | Polyethylene layer | 45 μm |
| | | Cast coat layer | 10 μm |
| | | Coated layer | 10 μm |
| | | Plain paper | 60 μm |
| | | Coated layer | 10 μm |
| | | Polyethylene layer | 35 μm |
| Backing Layer | Anti-curling layer | Gelatin | 3,500 |
| | | Film hardener (Note 2 in Example 1) | 70 |
| | | Silica (size: 4 μm) | 100 |

Sensitizing dye (D-1)

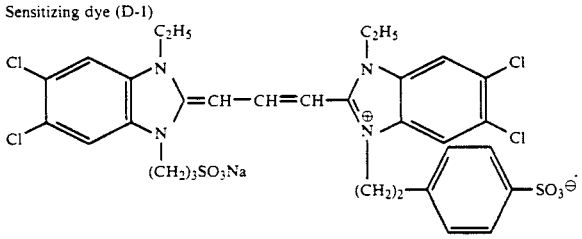

Sensitizing dye (D-2)

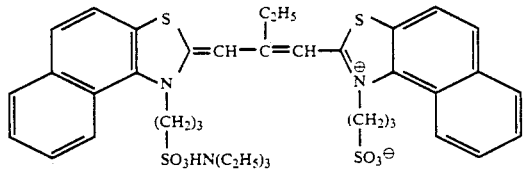

Sensitizing dye (D-3)

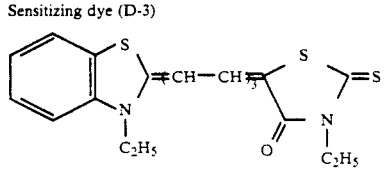

A light-sensitive material 202 was prepared in the same manner as in the light-sensitive material 201 except that the subbing layer was free of any light-insensitive silver halide emulsion.

The light-sensitive materials 201 and 202 were then subjected to the forced deterioration test in the same manner as in Example 1. These materials were then subjected to the following processing. Another group of the materials 201 and 202, which had not been subjected to the forced deterioration test, was subjected to the same processing.

These materials were exposed to light of 500 lux from a tungsten lamp through G, R, and IR separation filters having a gradient density (G filter was made of a filter passing 500 to 600 nm, R filter was made of a filter passing 600 to 700 nm and IR filter was made of a filter passing 600 to 700 nm and IR filter was made of a filter passing 700 nm or more) over 1 second.

The emulsion surface of these exposed light-sensitive materials were supplied with water in an amount of 12 $ml/m^2$ through a wire bar. These materials were then each superposed on the dye fixing material (as prepared in Example 1) in such a manner that their film surfaces were brought into contact with each other. These laminations were then heated for 25 seconds over a heat roller which had been adjusted so that the temperature of the water-absorbed film reached 93° C. When the dye fixing material was then stripped off the light-sensitive materials, sharp yellow, magenta and cyan images were obtained on the dye fixing material in correspondence to G, R and IR separation filter, respectively. These images were then measured by a Macbeth reflection densitometer (RD-5.19) for the maximum density (Dmax) and minimum density (Dmin) of each color.

The results of these measurements are shown in Table 5.

TABLE 5

| Light-sensitive material No. | | Before forced deterioration test | | After storage at 40° C., 80% RH | |
|---|---|---|---|---|---|
| | | Dmax | Dmin | Dmax | Dmin |
| 201 | Cyan | 2.40 | 0.12 | 2.40 | 0.14 |
| | Magenta | 2.26 | 0.13 | 2.27 | 0.14 |
| | Yellow | 2.05 | 0.13 | 2.04 | 0.15 |
| 202 | Cyan | 2.41 | 0.16 | 2.41 | 0.24 |
| (compara- | Magenta | 2.23 | 0.14 | 2.23 | 0.17 |
| tive) | Yellow | 2.04 | 0.14 | 2.02 | 0.16 |

It is demonstrated from the results shown in Table 5 that the inventive light-sensitive material 201 exhibits a lower Dmin and a less increase in Dmin after storage than the comparative light-sensitive material 202.

While the invention has been described in detail and with reference to specific embodiments thereof, it will be apparent to one skilled in the art that various changes and modifications can be made therein without departing from the spirit and scope thereof.

What is claimed is:

1. A process for forming an image which comprises imagewise exposing a heat developable light-sensitive material comprising light-sensitive silver halide emulsion layers on a paper support, and thereafter heating the same to develop the image, wherein at least one subbing layer comprising a hydrophilic binder and at least one material capable of inhibiting fog selected from a light-insensitive silver halide, colloidal silver, an organic silver salt, activated carbon powder and a porous silicon dioxide powder is interposed between the undermost layer among said light-sensitive silver halide emulsion layers and said paper support, whereby fog is inhibited.

2. A process for forming an image as claimed in claim 1, wherein said at least one subbing layer comprises a hydrophilic binder and at least one light-insensitive silver halide capable of inhibiting fog.

3. A process for forming an image as claimed in claim 1, wherein said at least one subbing layer comprises a hydrophilic binder and at least one colloidal silver capable of inhibiting fog.

4. A process for forming an image as claimed in claim 1, wherein said at least one subbing layer comprises a hydrophilic binder and at least one organic silver salt capable of inhibiting fog.

5. A process for forming an image as claimed in claim 1, wherein said at least one subbing layer comprises a hydrophilic binder and at least one activated carbon powder capable of inhibiting fog.

6. A process for forming an image as claimed in claim 1, wherein said at least one subbing layer comprises a hydrophilic binder and at least one porous silicon dioxide powder capable of inhibiting fog.

7. A process for forming an image as claimed in claim 1, wherein said undermost layer among said light-sensitive silver halide emulsion layers is coated in sequence on said subbing layer which in turn is coated on said support.

8. A process for forming an image as claimed in claim 1, said heat developable light-sensitive material further comprising an organometallic salt as an oxidizing agent in combination with the light-sensitive silver halide.

9. A process for forming an image as claimed in claim 1, said heat developable light-sensitive material further comprising a dye providing compound which undergoes an oxidization coupling reaction with a color developing agent to form a dye.

10. A process for forming an image as claimed in claim 1, said heat developable light-sensitive material further comprising a diffusible dye providing compound, further comprising the steps of transferring the developed image to a dye fixing element.

11. A process for forming an image as claimed in claim 1, wherein the paper support is a polyethylene-laminated paper support.

12. A process for forming an image as claimed in claim 1, wherein said at least one subbing layer comprises a hydrophilic binder and at least one material capable of inhibiting fog selected from a light-insensitive silver halide, colloidal silver, an organic silver salt and activated carbon powder.

* * * * *